US008173009B2

(12) United States Patent
Kalnes

(10) Patent No.: US 8,173,009 B2
(45) Date of Patent: May 8, 2012

(54) PROCESS FOR IMPROVING A HYDROTREATED STREAM

(75) Inventor: Tom N. Kalnes, LaGrange, IL (US)

(73) Assignee: UOP LLC, Des Plaines, IL (US)

( * ) Notice: Subject to any disclaimer, the term of this patent is extended or adjusted under 35 U.S.C. 154(b) by 546 days.

(21) Appl. No.: 12/367,047

(22) Filed: Feb. 6, 2009

(65) Prior Publication Data

US 2010/0200458 A1 Aug. 12, 2010

(51) Int. Cl.
*C10G 49/04* (2006.01)

(52) U.S. Cl. ..... 208/18; 208/142; 208/143; 208/144; 208/145

(58) Field of Classification Search ..... 208/18, 208/142–145
See application file for complete search history.

(56) References Cited

U.S. PATENT DOCUMENTS

| | | | | |
|---|---|---|---|---|
| 4,840,721 | A | 6/1989 | Kalnes et al. | |
| 4,923,590 | A | 5/1990 | Kalnes et al. | |
| 5,176,816 | A | 1/1993 | Lankton et al. | |
| 5,290,744 | A | 3/1994 | Degnan Jr. et al. | |
| 5,302,282 | A * | 4/1994 | Kalnes et al. | 208/179 |
| 5,472,928 | A | 12/1995 | Scheuerman et al. | |
| 5,580,442 | A | 12/1996 | Kwon et al. | |
| 5,879,642 | A | 3/1999 | Trimble et al. | |
| 6,086,749 | A | 7/2000 | Kramer et al. | |
| 6,322,692 | B1 * | 11/2001 | Cody et al. | 208/18 |
| 6,379,532 | B1 * | 4/2002 | Hoehn et al. | 208/58 |
| 6,451,197 | B1 | 9/2002 | Kalnes | |
| 6,783,660 | B2 | 8/2004 | Dahlberg et al. | |
| 7,074,740 | B2 | 7/2006 | Gibson et al. | |
| 7,094,332 | B1 | 8/2006 | Kalnes et al. | |
| 7,261,805 | B2 | 8/2007 | Grove et al. | |
| 7,431,831 | B2 | 10/2008 | Farshid et al. | |
| 2006/0157386 | A1 | 7/2006 | Al-Naeem et al. | |
| 2009/0000985 | A1 | 1/2009 | Van Wees et al. | |

FOREIGN PATENT DOCUMENTS

WO WO-2008/130260 A1 10/2008

OTHER PUBLICATIONS

Sequeira, Jr., A. (1994). Lubricant Base Oil and Wax Processing, Marcel-Dekker, 288 pgs.*

Gardos et al., Investigation of Energy Conserving Lubricating Oil Producing Processes II., Hungarian Journal of Industrial Chemistry, 1983, vol. 11, No. 3, pp. 301-306.

Kalnes et al., High Quality Base Oil Production Via the HyLube Process, 2008 AIChE Spring National Meeting, Conference, Apr. 6-10, 2008, 2008, pp. 13 pages.

Linnard et al., Re-refine Waste Oil with PROP, Hydrocarbon Processing, Sep. 1979, vol. 58, No. 9, pp. 148-154.

L'Vov et al., Products from Vacuum Distillate Hydrocracking as Motor Oil Basestocks, Chemistry and Technology of Fuels and Oils, Sep-Oct 1984, vol. 20, No. 9-10, pp. 453-456.

* cited by examiner

*Primary Examiner* — Walter D Griffin
*Assistant Examiner* — Brian McCaig
(74) *Attorney, Agent, or Firm* — James C Paschall

(57) ABSTRACT

One exemplary embodiment can be a process for improving a hydrotreated stream for lubricating a machine. The hydrotreated stream can include an effective amount of one or more saturated hydrocarbons. Generally, the process includes hydrogenating the hydrotreated stream having no more than about 300 ppm, by weight, sulfur based on the weight of the stream in a hydrogenation reaction zone to produce a product stream having no more than about 5 ppm, by weight, sulfur.

20 Claims, 1 Drawing Sheet

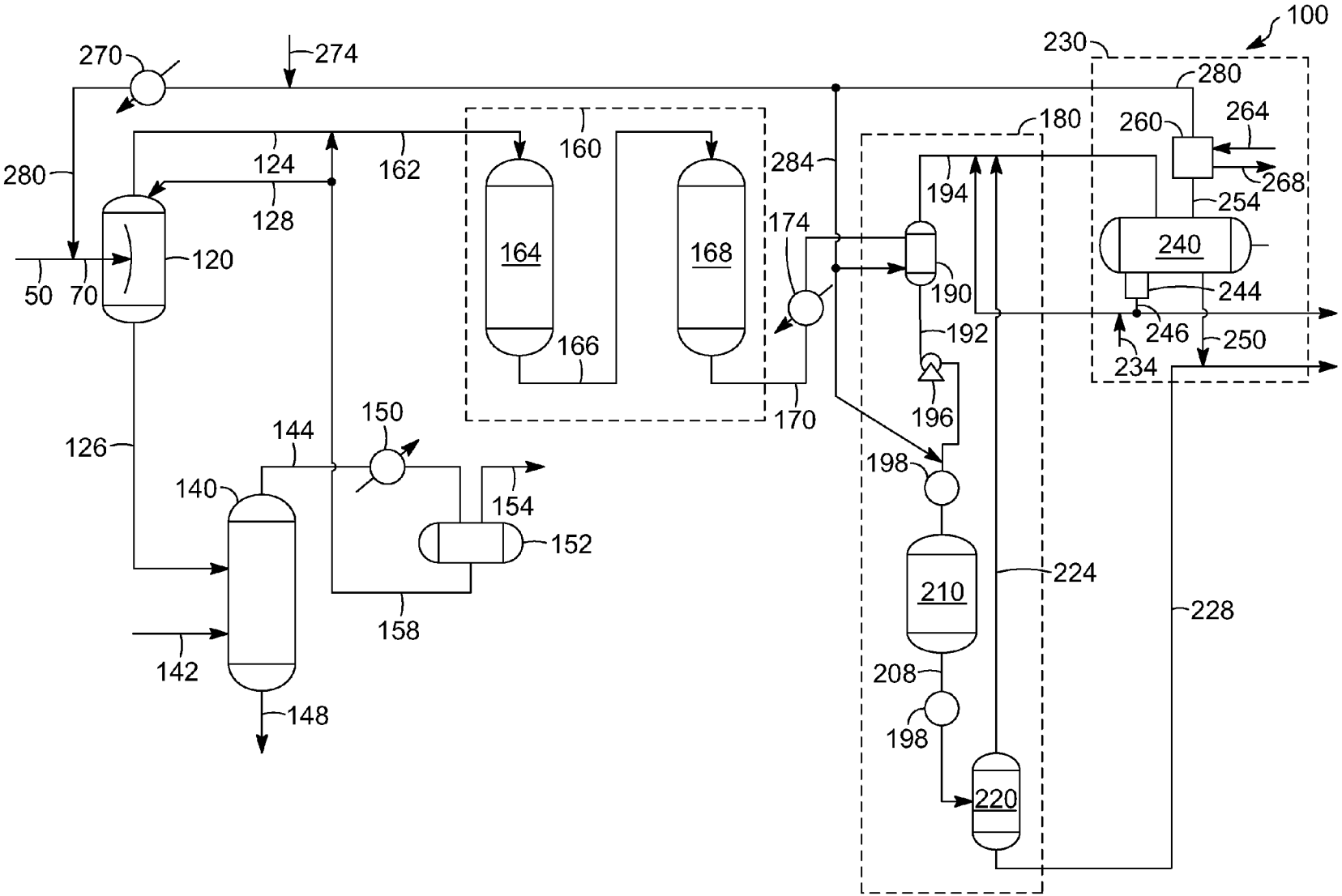
100
280
264
268
254
244
250
228
240
246
234
260
230
180
224
220
194
190
192
196
210
198
208
198
284
174
170
168
160
166
164
152
154
162
150
158
274
124
128
144
148
120
140
142
270
126
70
280
50

PROCESS FOR IMPROVING A HYDROTREATED STREAM

FIELD OF THE INVENTION

This invention generally relates to processes for treating a hydrocarbon stream for improving its properties, e.g., to serve as a lubricant for a machine.

DESCRIPTION OF THE RELATED ART

Generally, it is desirable to recycle and reprocess used petroleum based products, such as waste lubricating oils, or oil derived from carbonaceous waste. Reprocessing or re-refining can recover a substantial amount of product from spent lubricants and other carbonaceous waste materials in an environmentally safe manner.

High severity hydroprocessing may be used to produce highly saturated, hetero-atom free oils that can be used as either finished or intermediate products, such as lube oil blending stocks, petrochemical feedstocks, specialty oils and liquid transportation fuels. Also, technology that is used for re-refining waste lubricating oils often needs improvements to adapt to changing feedstocks that include non-traditional sources of hydrocarbons.

However, sometimes it is desirable to upgrade or enhance the hydrotreated oils. Particularly, oils can be segregated and defined by different grades, and higher grade products can have lower sulfur and higher saturate content. As a result, higher grade products can be valued more.

Unfortunately, often manufacturing facilities that are designed to manufacture products at certain grades and these facilities do not provide higher quality products. Moreover, impurities in the produced products may interfere with purification processes. Hence, there is a desire to provide a process to enhance a hydrotreated stream and optionally provide a process to revamp an existing unit to provide an enhanced product.

SUMMARY OF THE INVENTION

One exemplary embodiment can be a process for improving a hydrotreated stream for lubricating a machine. The hydrotreated stream can include an effective amount of one or more saturated hydrocarbons. Generally, the process includes hydrogenating the hydrotreated stream having no more than about 300 ppm, by weight, sulfur based on the weight of the stream in a hydrogenation reaction zone to produce a product stream having no more than about 5 ppm, by weight, sulfur.

In another exemplary embodiment, a process to revamp an existing oil lube manufacturing unit may include adding a reactor integration zone downstream of a hydrotreatment zone. Generally, the reactor integration zone includes at least one fluid transfer device, at least one heat exchanger, and at least one hydrogenation reaction vessel.

Yet another exemplary embodiment is a system for producing a stream having an effective amount of one or more saturated hydrocarbons for lubricating a machine. The system can include a hydrogenation reaction zone receiving a hydrotreated stream having no more than about 300 ppm, by weight, sulfur based on the weight of the hydrotreated stream to produce a product stream having no more than about 5 ppm, by weight, sulfur based on the weight of the product stream.

The embodiments disclosed herein can provide a hydrogenation process for improving or upgrading a hydrotreated stream to a higher quality product, such as a lube oil lubricant for a machine, such as an engine, a truck, a bus, or an automobile. Typically, lubricants can be sold at different grades depending on their purity. As an example, the American Petroleum Institute (hereinafter may be abbreviated "API") grades lubricant base oils into groups with Group I being the least refined and Group III being the most refined. Generally, a lubricant in Group III has a higher saturated hydrocarbon content, higher viscosity index, and lower amounts of impurities, such as sulfur, as compared to a lubricant in Group I, and may command a greater price and be used in a wider variety of specialized applications. The disclosed embodiments herein also provide a process for revamping an existing unit for providing such a higher quality product. As such, the embodiments can economically modify an existing process and/or unit for producing higher valued products.

DEFINITIONS

As used herein, the term "stream" can be a stream including various hydrocarbon molecules, such as straight-chain, branched, or cyclic alkanes, alkenes, alkadienes, and alkynes, and optionally other substances, such as gases, e.g., hydrogen, or impurities, such as heavy metals, halogens, oxygenates, and various sulfur and nitrogen compounds. The stream can also include aromatic and non-aromatic hydrocarbons. Moreover, the hydrocarbon molecules may be abbreviated C1, C2, C3 . . . Cn where "n" represents the number of carbon atoms in the one or more hydrocarbon molecules.

As used herein, the term "zone" can refer to an area including one or more equipment items and/or one or more sub-zones. Equipment items can include one or more reactors or reactor vessels, heaters, exchangers, pipes, pumps, compressors, and controllers. Additionally, an equipment item, such as a reactor, dryer, or vessel, can further include one or more zones or sub-zones.

As used herein, the term "rich" can mean an amount of generally at least about 50%, by mole, of a compound or class of compounds in a stream.

As used herein, the term "substantially" can mean an amount of generally at least about 80%, preferably about 90%, and optimally about 99%, by mole, of a compound or class of compounds in a stream.

As used herein, the term "hydrogenation reaction zone" can mean a zone containing any reaction of an organic compound in the presence of or with hydrogen. The reaction may occur as a direct addition of hydrogen to double bonds of unsaturated molecules, resulting in a saturated product, or it may cause a rupture of the bonds of organic compounds, with a subsequent reaction of hydrogen with molecular fragments. Exemplary reactions can include conversion of one or more aromatics to one or more cycloparaffins, the hydrogenation of olefins, isomerization of one or more normal paraffins to one or more isoparaffins, and selective ring opening of one or more cycloparaffins to one or more isoparaffins. As a consequence, the term "hydrogenating" can include reactions such as isomerizing and selective ring opening.

As used herein, the term "saturated hydrocarbons" can include one or more cycloparaffins, one or more isoparaffins, and/or one or more normal paraffins. In some preferred embodiments, one or more cycloparaffins can be derived from one or more aromatic compounds and one or more isoparaffins can be derived from one or more normal paraffins.

As used herein, the term "vapor" can mean a gas or a dispersion that may include or consist of one or more hydrocarbons.

As used herein, the term "vaporization" can mean using at least one of heat and pressure to change at least a portion of a liquid to a gas optionally forming a dispersion, such as a gas entraining at least one of liquid and solid particles.

BRIEF DESCRIPTION OF THE DRAWINGS

FIG. 1 is a schematic depiction of an exemplary unit and/or system for improving and/or upgrading a hydrotreated stream.

DETAILED DESCRIPTION

FIG. 1 is a schematic depiction of an exemplary lube oil manufacturing unit and/or system 100 that can include a flash separator 120, a vacuum stripper 140, a hydrotreatment zone 160, a reactor integration or hydrogenation reaction zone 180, and a product separation and recycle gas scrubbing zone 230. As depicted, process flow lines in the figures can be referred to as lines, pipes, streams, effluents, oils, liquids, or gases. Particularly, a line or a pipe can contain one or more streams, effluents, oils, liquids, and/or gases, and one or more streams, effluents, oils, liquids, and/or gases can be contained by a line or a pipe.

A feed stream 50 can be provided to the flash separator 120. The feed stream 50 may include used and recycled lube oils. Alternatively, the feed stream 50 may also include petroleum based products and byproducts such as slurry oil from FCC processes; atmospheric residuum; spent solvents and still bottoms from solvent recovery operations; used dielectric fluids; hydrocarbons contaminated with chlorinated biphenyls; coal tars; halogenated wastes; unconventional crudes that are contaminated with high amounts of non-distillable solids, such as Canadian oil sands, high acid number South American bitumens, and unrefined shale oils; synthetic materials, such as liquids derived from vaporization and Fischer-Tropsch synthesis; chlorinated byproducts from the manufacture of vinyl chloride monomer and propylene oxide; polymers not meeting specification; oils derived from depolymerizing old tires and other plastics and rubbers; and biologically derived oils such as black liquor from pulp and paper, tall oils, vegetable oils containing alkaline metals or salts, waste greases, tallow oils and other oils derived from animal fats. Such feeds can be reprocessed into a lubricant.

Generally, the feed stream 50 is contacted with a heated recycle gas stream 280, typically rich in hydrogen, to form a combined stream 70 before entering the flash separator 120. The recycle gas stream 280 can serve as a heat source to directly heat the feed stream 50 to preclude coke formation that could occur if using an indirect heating apparatus such as a heater or heat exchanger. The recycle gas stream 280 can also serve as a diluent to reduce the partial pressure of the feed during vaporization in the flash zone, a reactant to minimize the formation of polymers at elevated temperatures, and a stripping medium. The recycle gas stream 280 can also provide at least a portion of the hydrogen required in the hydrotreatment zone 160. Typically, the recycle gas stream 280 is maintained at a temperature higher than the feed stream 50, and is preferably at a temperature of about 260-about 650° C.

Usually, the operating conditions of the flash separator 120 include a temperature of about 200-about 650° C., a pressure of about 100-about 14,000 kPa, a hydrogen feed ratio of about 170-about 16,850 normal $m^3$ $H_2/m^3$ oil, based on the feed stream 50, and an average residence time of the combined stream 70 of about 0.1-about 50 seconds, with a preferred average residence time of about 1-about 10 seconds. The contact conditions in the flash separator 120 may allow adverse reactions such as thermal degradation. Preferably, the liquid residence time in the separator 120 maximizes the vaporization of the hydrocarbons while simultaneously minimizing adverse thermal reactions. The residence time can vary based upon the feed stream 50 and the corresponding temperature required to vaporize the components in the feed stream 50.

In the flash separator 120, a portion of the combined stream 70 can vaporize, and generate an overhead stream 124, typically rich in one or more gases, and a bottom stream 126, typically rich in one or more liquids. The overhead stream 124 can include hydrogen from the recycle stream 280 and hydrocarbons vaporized from the feed stream 50. In some preferred embodiments, a wash oil or a flush liquid 128 can be provided to wash non-distillable components contained in the feed stream 50 from the flash separator 120. A wash oil or flush liquid can include an oil having a high boiling point range, such as a heavy vacuum gas oil, an atmosphere residue, or a vacuum tower bottoms stream. The selection of the wash oil or flush liquid can depend upon the composition of the feed stream 50 and the prevailing conditions in the flash separator 120. Preferably, the volume of the wash oil 128 is preferably limited to that required for the removal of the heavy non-distillable component. In this preferred embodiment, the wash stream 128 can be obtained from downstream processing, as hereinafter described.

A wash stream 128, as hereinafter described, may be sprayed into a top section of the flash separator 120 and can be used to wash entrained solids and metals out of the gases. An alternative to a sprayer in the top section of the flash separator 120 can be a packed section or trays. The gases passing through a packed or trayed section contact the wash oil distributed over the packed or trayed section to remove entrained tars, solids and metals from the gases. The amount of the wash stream 128 passed is dependent on the amount of non-distillables in the feed stream 50, but it is estimated that about 5-about 40%, by weight, of a liquid stream 158, as hereinafter described, can be used for washing.

The bottom stream 126, which can contain residual distillable hydrocarbons, may be provided to a vacuum stripper 140, optionally without intermediate heating or cooling. Although a vacuum stripper 140 is disclosed, other stripping columns may also be used instead. A gas stream 142, such as super-heated steam or hydrogen, may be used to strip the bottom stream 126 and generate an overhead vapor stream 144 and a liquid bottom stream 148. The remaining bottom stream 148 from the vacuum stripper 140 is a residue stream that can include non-distillable components such as solids and other impurities. Preferably, the stripping operation minimizes the amount of distillable components to less than about 60%, by weight, and more preferably to less than about 40%, by weight, based on the weight of the bottom stream 148. Optionally, such material in the bottom stream 148 may be sold as asphalt-blending components or as a supplemental fuel in a cement kiln or steel mill, or routed to other units for further processing. Generally, the vacuum stripper 140 maximizes the amount of useful hydrocarbons.

Usually, the overhead stream 144 is gas stream containing hydrocarbons that may be condensed in an exchanger 150 to liquefy the hydrocarbons recovered in the vacuum stripper 140 and passed to a receiver or warm separator 152. A condensed liquid stream 158 may be separated and recovered. An uncondensed gas stream 154 may be processed for further separation. In a preferred embodiment, the receiver 152 is operated at a temperature above the dew point of a stripping gas. The liquid stream 158 can provide at least a portion of a wash stream 128, as discussed above, and be combined with the overhead stream 124 to form a feed 162, typically containing hydrogen and hydrocarbons, for the hydrotreatment zone 160. If the gas stream 142 includes steam, than a condensate may be removed as a separate stream from the receiver or warm separator 152. The liquid stream 158 can control the temperature of the overhead stream 124 by providing cooling before undertaking reactions in the hydrotreatment zone 160.

The hydrotreatment zone 160 can include any number and type of hydrotreating reactors, such as a first hydrotreating reactor 164 and a second hydrotreating reactor 168 for producing a lubricant product. In this preferred embodiment, the first hydrotreating reactor 164 can be a hydrodemetallization reactor and the second hydrotreating reactor 168 can be a hydroprocessing reactor. The reactors 164 and 168 may, independently, contain one or more fixed, fluidized, or ebullated catalyst beds. The feed 162 may be passed to the hydrodemetallization reactor 164 and contacted with a hydrodemetallization catalyst at hydrodemetallization conditions, and generate an effluent 166.

The hydrodemetallization reaction conditions can include a temperature of about 150-about 450° C., and a pressure of about 100-about 14,000 kPa, preferably about 790-about 12,500 kPa. Generally, the reaction conditions include a hydrogen to feed ratio of about 33.7-about 16,850 normal $m^3$ $H_2/m^3$ oil, preferably about 50.5-about 16,850 normal $m^3$ $H_2/m^3$ oil based on the feed 162, and a weighted hourly space velocity (WHSV) of about 0.05-about 20 $hr^{-1}$.

Suitably, the reaction is conducted with a maximum catalyst temperature in the range selected to perform the desired hydrodemetallization conversion and reduce undesirable components. It is contemplated that the desired demetallization can include dehalogenation, desulfurization, denitrification, olefin saturation, removal of organic phosphorous and organic silicon, and oxygenate conversion.

The preferred composition of the hydrodemetallization catalyst is an inorganic oxide material, which can include porous or non-porous catalyst materials of at least one of a silica, an alumina, a titania, a zirconia, a carbon, a silicon carbide, a silica-alumina, a diatomaceous earth, a clay, a magnesium, an activated carbon, and a molecular sieve. A silica alumina may be amorphous or crystalline and include silicon oxide structural units. A mixture of hydrodemetallization catalysts may be used, depending on the feed 162. In another preferred embodiment, the catalyst can include a metal deposited on the inorganic oxide material. A suitable metal deposited on the support for hydrodemetallization activity may include at least one metal from group VIB and VIII. Thus, a catalyst may include one or more metals of chromium, molybdenum, tungsten, iron, ruthenium, osmium, cobalt, rhodium, iridium, nickel, palladium, and platinum. Usually, the amount of an active metal component is dependent on the particular metal and the physical and chemical characteristics of the particular feed 162. The metal component of group VIB can be in an amount of about 1-about 20%, by weight; the iron-group metal component of group VIII may be in an amount of about 0.2-about 10%, by weight; and the noble metal of group VIII can be in an amount of about 0.1-about 5%, by weight, based on the total weight of the catalyst. It is further contemplated that the hydrodemetallization catalyst may also include at least one of cesium, francium, lithium, potassium, rubidium, sodium, copper, gold, silver, cadmium, mercury and zinc.

In addition, the first hydrotreating reactor 164 can include non-catalytic reactor media to filter solid particulates, such as ring packing sold under the trade designation RASCHIG packing and/or high void volume, low surface area alumina-silicates. These non-catalytic reactor media can be used instead of or addition to the hydrodemetallization catalyst.

Typically, the effluent 166 is passed to a hydroprocessing reactor 168 and contacted with a hydroprocessing catalyst to increase the hydrogen content in the hydrocarbons. Generally, the hydroprocessing reacts with the hydrocarbons to remove sulfur compounds, to perform deep denitrification and hydrodeoxygenation of the hydrocarbons, and to saturate aromatic compounds. Suitably, the reaction is conducted with a catalyst temperature in the range selected to perform the desired hydroprocessing conversion or to reduce undesirable components. The hydroprocessing reaction conditions can include a temperature of about 200-about 450° C., and a pressure of about 100-about 14,000 kPa. The reaction conditions can include a hydrogen to feed ratio of about 33.7-about 16,850 normal $m^3$ $H_2/m^3$ oil, preferably about 50.5-about 16,850 normal $m^3$ $H_2/m^3$ oil based on the effluent 166 from the reactor 164, and a weighted hourly space velocity (WHSV) of about 0.05-about 20 $hr^{-1}$. The preferred composition of a hydroprocessing catalyst disposed within the hydroprocessing reactor can generally be characterized as containing at least one metal, as described above for the hydrodemetallization reactor, having hydrogenation activity combined with a suitable refractory inorganic oxide carrier material of either synthetic or natural origin, such as silica or alumina.

Desirably, the processing conditions are at a temperature and under sufficient hydrogen partial pressure that some hydrocracking of the larger hydrocarbon molecules may occur. Generally, the hydroprocessing reactor 168 is operated at hydroprocessing conditions to produce an effluent 170 including hydroprocessed hydrocarbons. The hydrotreated stream 170 can be cooled with a cooling water exchanger 174 to provide a gas-liquid stream sent to the reactor integration or hydrogenation reaction zone 180.

The reactor integration or hydrogenation reaction zone 180 can be provided in a new design or added to an existing lube oil manufacturing unit. The addition of such a zone may provide a mechanism for improving or upgrading the hydrotreated stream 170 that can provide a higher quality product with higher saturated hydrocarbon purity, higher viscosity index, improved thermal stability, improved oxidation stability, lower volatility, and lower levels of impurities, such as sulfur.

The reactor integration or hydrogenation reaction zone 180 can include a high pressure separator 190, at least one fluid transfer device 196, at least one heat exchanger 198, at least one hydrogenation reaction vessel 210, and a separator 220. The high pressure separator 190 can receive the effluent 170 and provide a hydrotreated or liquid stream 192 including one or more hydrocarbons, and a gas stream 194 including hydrogen, gaseous water-soluble inorganic compounds, and lower boiling hydrocarbons. Moreover, dissolved gases that may affect subsequent catalytic reactions can be removed by providing a stripping gas 284 including hydrogen from the scrubbing zone 230. Such dissolved gases can include water, hydrogen sulfide, hydrogen chloride, carbon dioxide, carbon monoxide, and ammonia. Typically, the high pressure separator 190 can operate at a temperature of about 150-about 290° C. and a pressure of about 790-about 12,500 kPa. Generally, the hydrotreated or liquid stream 192 has recovered liquid hydrocarbons for use as lubricating oil product stream or other commercially valuable liquids.

Usually, the hydrotreated stream 192 can have an effective amount of one or more saturated C5-C50, preferably C15-C30, hydrocarbons for lubricating a machine, such as at least about 85%, preferably at least about 90%, by weight, saturated hydrocarbons and no more than about 300 ppm, by weight, sulfur based on the weight of the hydrotreated stream 192. In addition, the hydrotreated stream 192 may have a viscosity index of at least about 115. The hydrotreated stream 192 can be effective as a lubricant and may exceed a Group II API rating, but typically not a Group III API rating.

Afterwards, the hydrotreated stream 192 can be communicated with the at least one fluid transfer device 196, which typically is one or more pumps. The hydrotreated stream 192 can be transferred to at least one heat exchanger 198, optionally receiving a portion of the stripping gas 284 if additional hydrogen is required. In this instance, the at least one heat exchanger 198 can be a feed heat exchanger to warm the hydrotreated stream 192 before entering the at least one hydrogenation reaction vessel 210.

The at least one hydrogenation reaction vessel 210 can receive the hydrotreated stream 192. The at least one hydrogenation reaction vessel 210 can be a single reactor or a plurality of reactors in parallel and/or series flow. The at least one hydrogenation reaction vessel 210 can include, independently, one or more fixed, fluidized, or ebullated catalyst beds. The at least one hydrogenation vessel 210 can be operated at a temperature of about 50-about 500° C., preferably 200-300° C., and optimally about 260° C., and a pressure of about 100-about 14,000 kPa, preferably 5,600-7,000 kPa. A liquid hourly space velocity can be in the range of about 0.05-about 20 $hr^{-1}$ and the hydrogen circulation rate can be about 30-about 8500 normal $m^3/m^3$ of feed.

Generally, any suitable catalyst can be utilized, such as those catalysts including one or more group VIII metals, preferably one or more noble group VIII metals, and one or more group VIB metals. The one or more metals may include at least one of molybdenum, tungsten, chromium, iron, cobalt, nickel, platinum, palladium, iridium, osmium, rhodium, and ruthenium. The one or more metals can be included, independently, in an amount of about 0.1-about 20%, by weight, based on the weight of the catalyst. The one or more metals can be combined with a suitable refractory inorganic oxide carrier material of either synthetic or natural origin, such as silica, alumina, or a beta zeolite. Moreover, the carrier material can be amorphous or crystalline. Other additional components can include at least one of cesium, francium, lithium, potassium, rubidium, sodium, copper, gold, silver, cadmium, mercury, and zinc. In one preferred embodiment, the catalyst can include nickel and tungsten, or nickel and molybdenum deposited on a slightly acidic support, such as a catalyst disclosed in Example 1 of U.S. Pat. No. 5,290,744 and as a comparison in US 2006/0157386 A1. If a noble group VIII metal is utilized, it is generally desirable to remove dissolved gases, such as water, hydrogen sulfide, hydrogen chloride, carbon dioxide, carbon monoxide, and ammonia, which may poison the catalytic metal, from the feed, as described above. Although not wanting to be bound by theory, typical reactions can include aromatic saturation, normal paraffin isomerization, and selective cycloparaffin ring opening. Exemplary hydrogenation conditions and catalysts are disclosed in, e.g., U.S. Pat. No. 4,923,590.

The effluent 208 exiting the at least one hydrogenation reaction vessel 210 can be passed through the at least one heat exchanger 198, preferably a heat exchanger, before being passed to the separator 220. An overhead stream 224 containing gases such as hydrogen can be withdrawn from the top while a liquid stream 228 can be withdrawn from the bottom. The product stream 228 can have a saturated hydrocarbon content of at least about 98%, preferably at least about 99%, by weight, and a sulfur content of no more than about 5 ppm, preferably no more than about 1 ppm, by weight, sulfur based on the weight of the product stream 228. Moreover, the product stream 228 can have a viscosity index of at least about 120-about 121. Typically, the product stream 228 may meet or exceed a Group III API rating. Usually, the product stream 228 includes an effective amount of C5-C50, preferably C15-C30, saturates for acting as a lubricant for a machine, such as an automobile, a bus, or a truck, having one or more metal components.

The gas stream 194 can be quenched with a scrubbing solution stream 234, and the overhead stream 224 before entering the scrubbing zone 230. Typically, a combined stream enters the scrubbing separator, mixes and separates into a spent scrubbing stream and a gas stream 254 rich in hydrogen. The contact with the scrubbing solution can be performed in any convenient manner, including in-line mixing. The scrubbing solution is preferably in an amount of about 1-about 100%, by volume, based on the effluent 170 from the hydrotreatment zone 160.

The scrubbing zone 230 can include a scrubbing separator 240 and a scrubber 260. The scrubbing solution can remove acidic gases and ammonia in the gas stream 194, and to allow the recycle of the hydrogen gas. The scrubbing solution preferably can include a basic compound such as sodium carbonate or ammonium hydroxide that may neutralize and dissolve water soluble inorganic compounds. Usually, a water wash may be injected above the caustic wash to remove ammonia and/or any entrained sodium hydroxide. A boot 244 of the scrubbing separator 240 can receive separated scrubbing solution via gravity and pass the solution via a boot line 246. Subsequently, the solution can be mixed with the gas stream 194 or pass from the unit 100. Also, a product can be removed in a product line 250 and be combined with the product stream 228.

In one preferred embodiment, the gas stream 254 may be passed to a scrubber 260 for removal of additional hydrogen sulfide. The scrubber 260 can receive a caustic solution, such a sodium hydroxide solution, in a caustic line 264 for scrubbing the gas stream 254, and pass a scrubber effluent 268 from the scrubber 260. The recycle gas stream 280 emerging from the scrubber 260 can be preferably more than about 70%, by volume, and more preferably more than about 85%, by volume, hydrogen. A portion may be provided as a stripping gas 284 and to the high pressure separator 190 and/or as a reaction gas downstream of the at least one fluid transfer device 196. The recycle gas stream 280 may optionally receive additional hydrogen from a make-up stream 274 before being heated in an exchanger 270 for contacting the feed stream 50. Preferably, the temperature of the recycle gas stream 280 is sufficiently high to ensure flash vaporization of at least a portion of the distillable hydrocarbons in the feed stream 50.

In the above streams, the saturates content can be measured by ASTM D-2007 (2001), the sulfur content can be measured by EN ISO 8754 (2003) and ASTM D-4294 (2002), and the viscosity index can be measured by DIN ISO 2909 (2002) and ASTM D-2270 (2004).

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing, all temperatures are set forth in degrees Celsius and, all parts and percentages are by weight, unless otherwise indicated.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for improving a hydrotreated stream, comprising an effective amount of one or more saturated hydrocarbons, for lubricating a machine, comprising:

A) passing the hydrotreated stream through a high pressure separator operated at a temperature of about 150-about 290° C. for removing one or more dissolved gases from a hydrotreated liquid stream before entering a hydrogenation reaction zone; and B) hydrogenating the hydrotreated liquid stream comprising no more than about 300 ppm, by weight, sulfur based on the weight of the stream in the hydrogenation reaction zone to produce a product stream having no more than about 5 ppm, by weight, sulfur and at least about 98%, by weight, of one or more saturated hydrocarbons based on the weight of the product stream.

2. The process according to claim 1, wherein the one or more saturated hydrocarbons comprise one or more C5-C50 hydrocarbons.

3. The process according to claim 1, wherein the one or more saturated hydrocarbons comprise one or more C15-C30 hydrocarbons.

4. The process according to claim 1, wherein the hydrotreated liquid stream comprises at least about 85%, by weight, of one or more saturated hydrocarbons based on the weight of the hydrotreated stream.

5. The process according to claim 1, wherein the product stream comprises at least about 98%, by weight, of one or more saturated hydrocarbons based on the weight of the product stream.

6. The process according to claim 1, wherein the reaction gas to the hydrogenation step is obtained from a scrubbing zone.

7. The process according to claim 1, wherein the separator receives a stripping gas comprising hydrogen.

8. The process according to claim 7, wherein the stripping gas is obtained from a scrubbing zone.

9. The process according to claim 1, wherein the hydrogenation reaction zone contains a catalyst, in turn, comprising one or more noble group VIII metals.

10. The process according to claim 1, wherein the hydrotreated stream comprises dissolved amounts of at least one of water, hydrogen sulfide, hydrogen chloride, carbon dioxide, carbon monoxide, and ammonia in an amount sufficient to detrimentally affect one or more hydrogenation reactions.

11. The process according to claim 1, further comprising at least one heat exchanger to heat the hydrotreated stream before entering the hydrogenation reaction zone.

12. The process according to claim 1, wherein the hydrogenation reaction zone is conducted at conditions effective to saturate one or more aromatic hydrocarbon compounds and isomerize one or more normal paraffins.

13. The process according to claim 12, wherein the hydrogenation reaction zone is at a temperature of about 50-about 500° C. and a pressure of about 100-about 14,000 kPa.

14. A process to revamp an existing oil lube manufacturing unit, comprising:

A) adding a reactor integration zone downstream of a hydrotreatment zone and a high pressure separator of a lube oil manufacturing unit, comprising:

1) at least one fluid transfer device;

2) at least one heat exchanger; and 3) at least one hydrogenation reaction vessel.

15. The process according to claim 14, wherein the reactor integration further comprises a line for providing a recycle gas to the high pressure separator.

16. The process according to claim 14, wherein the reactor integration further comprises a line for providing a recycle gas as a reaction gas downstream of the at least one fluid transfer device.

17. The process according to claim 14, wherein the at least one fluid transfer device comprises a pump.

18. The process according to claim 14, wherein the reactor integration zone further comprises a separator.

19. A process for producing a stream comprising an effective amount of one or more saturated hydrocarbons for lubricating a machine, comprising:

A) passing a hydrotreated stream through a high pressure separator for removing one or more dissolved gases to provide a liquid stream comprising no more than about 300 ppm, by weight, sulfur based on the weight of the hydrotreated stream;

B) receiving a stripping gas comprising hydrogen in said high pressure separator;

C) receiving said liquid stream in a hydrogenation reaction zone; and

D) passing effluent exiting the hydrogenation reaction zone to a separator to produce a product stream having no more than about 5 ppm, by weight, sulfur based on the weight of the product stream.

20. The process according to claim 19, wherein the product stream comprises at least about 98%, by weight, of one or more saturated hydrocarbons based on the weight of the product stream.

* * * * *